US008371400B2

(12) United States Patent
Hall et al.

(10) Patent No.: US 8,371,400 B2
(45) **Date of Patent: *Feb. 12, 2013**

(54) DOWNHOLE TOOL ACTUATION

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 306 days.

This patent is subject to a terminal disclaimer.

(21) Appl. No.: 12/391,376

(22) Filed: Feb. 24, 2009

(65) Prior Publication Data

US 2010/0212966 A1 Aug. 26, 2010

Related U.S. Application Data

(63) Continuation of application No. 12/391,358, filed on Feb. 24, 2009.

(51) Int. Cl.
*E21B 10/32* (2006.01)

(52) U.S. Cl. ..... 175/273; 175/107; 175/267; 175/106

(58) Field of Classification Search ..... 175/107, 175/267, 273, 406

See application file for complete search history.

(56) References Cited

U.S. PATENT DOCUMENTS

| | | | | |
|---|---|---|---|---|
| 1,258,418 | A | | 3/1918 | Kemble |
| 1,712,948 | A | | 5/1929 | Burch |
| 1,921,135 | A | | 8/1933 | Santiago |
| 2,153,034 | A | | 4/1939 | Baker |
| 2,170,452 | A | | 8/1939 | Grant |
| 2,196,657 | A | | 4/1940 | Burt |
| 2,320,670 | A | | 6/1943 | Scaramucci |
| 2,427,052 | A | | 9/1947 | Grant |
| 2,615,519 | A | | 10/1952 | Carr |
| 2,737,244 | A | | 3/1956 | Baker et al. |
| 3,001,584 | A | | 9/1961 | Scott |
| 3,039,531 | A | | 6/1962 | Scott |
| 3,054,415 | A | | 9/1962 | Baker et al. |
| 3,126,065 | A | | 3/1964 | Chadderdon |
| 3,130,783 | A | | 4/1964 | Orr |
| 3,403,729 | A | | 10/1968 | Hickey |
| 3,703,104 | A | | 11/1972 | Tamplen |
| 3,705,603 | A | * | 12/1972 | Hawk ..... 175/50 |
| 3,758,731 | A | | 9/1973 | Vann et al. |
| 3,823,773 | A | | 7/1974 | Nutter |
| 3,982,224 | A | * | 9/1976 | Patton ..... 367/84 |
| 3,986,554 | A | | 10/1976 | Nutter |
| 4,007,797 | A | * | 2/1977 | Jeter ..... 175/26 |
| 4,033,408 | A | | 7/1977 | Fredd et al. |
| 4,081,042 | A | | 3/1978 | Johnson |
| 4,132,243 | A | | 1/1979 | Kuus |
| 4,266,605 | A | | 5/1981 | LaBorde et al. |
| 4,491,187 | A | | 1/1985 | Russell |
| 4,520,870 | A | | 6/1985 | Pringle |
| 4,574,894 | A | | 3/1986 | Jadwin |
| 4,596,293 | A | | 6/1986 | Wallussek et al. |
| 4,655,289 | A | | 4/1987 | Schoeffler |
| 4,782,894 | A | | 11/1988 | LaFleur |
| 4,869,100 | A | | 9/1989 | Birdwell |
| 4,889,199 | A | | 12/1989 | Lee |

(Continued)

*Primary Examiner* — Shane Bomar
*Assistant Examiner* — Elizabeth Gitlin
(74) *Attorney, Agent, or Firm* — Brinks Hofer Gilson & Lione

(57) ABSTRACT

A downhole tool string component has at least one end adapted to connect to an adjacent tool sting component and a bore adapted to accommodate a flow of drilling fluid. A turbine is disposed within the bore and an actuating assembly is arranged such that a clutch may mechanically connect and disconnect with the turbine.

9 Claims, 18 Drawing Sheets

U.S. PATENT DOCUMENTS 4,893,678 A 1/1990 Stokley et al.
4,895,214 A 1/1990 Schoeffler
4,928,520 A 5/1990 Barrington
5,189,645 A 2/1993 Innes
5,230,390 A 7/1993 Zastresek
5,316,094 A 5/1994 Pringle
5,392,862 A 2/1995 Swearingen
5,499,687 A 3/1996 Lee
5,553,678 A 9/1996 Barr
5,584,342 A 12/1996 Swinford
5,609,178 A 3/1997 Hennig
5,673,763 A 10/1997 Thorp
5,685,379 A 11/1997 Barr
5,695,015 A 12/1997 Barr
5,706,905 A 1/1998 Barr
5,730,222 A 3/1998 Rike
5,803,185 A 9/1998 Barr
5,833,002 A 11/1998 Holcombe
5,856,790 A 1/1999 Baugh et al.
6,089,332 A 7/2000 Barr
6,142,250 A 11/2000 Griffin
6,382,330 B2 5/2002 Bischel et al.
6,390,200 B1 5/2002 Allamon et al.
6,419,014 B1 * 7/2002 Meek et al. ..... 175/45
6,431,270 B1 8/2002 Angle
6,520,271 B1 * 2/2003 Martini ..... 175/21
6,561,289 B2 * 5/2003 Portman et al. ..... 175/104
6,571,888 B2 6/2003 Comeau et al.
6,619,388 B2 9/2003 Dietz et al.
6,717,283 B2 4/2004 Skinner
6,732,817 B2 5/2004 Dewey
6,776,240 B2 8/2004 Kenison et al.
6,854,953 B2 2/2005 Van Drentham-Susman
6,920,930 B2 7/2005 Allamon et al.
7,036,611 B2 5/2006 Radford
7,048,078 B2 5/2006 Dewey
7,178,611 B2 * 2/2007 Zupanick ..... 175/75
7,219,747 B2 * 5/2007 Gleitman et al. ..... 175/40
7,261,184 B2 8/2007 Bass et al.
7,308,937 B2 12/2007 Radford
7,331,397 B1 2/2008 Wagley et al.
7,481,282 B2 * 1/2009 Horst et al. ..... 175/61
7,637,323 B2 12/2009 Schasteen et al.
2004/0256153 A1 12/2004 Helms et al.
2005/0145417 A1 7/2005 Radford
2006/0034154 A1 2/2006 Perry et al.
2006/0243455 A1 11/2006 Telfer et al.
2007/0017679 A1 1/2007 Wolf et al.
2007/0056724 A1 * 3/2007 Spring et al. ..... 166/66.4
2007/0062706 A1 3/2007 Leising
2007/0107944 A1 5/2007 Lee
2007/0242565 A1 * 10/2007 Hall et al. ..... 175/48
2007/0251696 A1 11/2007 Parks
2008/0041597 A1 2/2008 Fisher et al.
2008/0105464 A1 5/2008 Radford
2008/0217024 A1 9/2008 Moore
2008/0296015 A1 * 12/2008 Hall et al. ..... 166/237
2009/0044951 A1 2/2009 Milkovisch et al.
2009/0056497 A1 3/2009 Swinford
2009/0126936 A1 5/2009 Begley et al.
2009/0166086 A1 7/2009 Sugiura
2009/0324348 A1 * 12/2009 Cooley et al. ..... 407/71
2010/0132954 A1 6/2010 Telfer
2011/0278017 A1 11/2011 Themig et al.

* cited by examiner

DOWNHOLE TOOL ACTUATION

CROSS REFERENCE TO RELATED APPLICATIONS

This application is a continuation of U.S. patent application Ser. No. 12/391,358 filed on Feb. 24, 2009, which is incorporated in its entirety by this reference for all purposes.

FIELD

Embodiments of the invention relate to methods and mechanisms to actuate components of downhole tools and, more specifically, downhole tools for oil, gas, geothermal, and horizontal drilling.

BACKGROUND OF THE INVENTION

Actuating downhole tools disposed in a well-bore is often accomplished by dropping a ball down a bore of a drill string to break shear pins, which upon breaking frees a valve to open or actuate a downhole tool, such as a reamer. Once the shear pins are broken, the downhole tool and, consequently, the drill string must be removed from the well-bore to replace them. Other disadvantages, such as an inability to reset the actuating mechanism of the downhole tool while the downhole tool is still in the well-bore are inherent in this type of design.

BRIEF SUMMARY OF THE INVENTION

In one aspect of the present invention, a downhole tool string component has at least a first end with an attachment to an adjacent tool string component and a second end spaced apart from the first end for attachment to another adjacent tool string component. The downhole tool string component includes a bore between the first end and the second end and a turbine disposed within the bore. An actuating assembly is arranged in the bore such that when actuated a clutch mechanically connects the actuating assembly to the turbine. When the actuating assembly is deactivated, the actuating assembly and turbine are mechanically disconnected.

The actuating assembly may move a linear translation mechanism, which may include a sleeve. The sleeve may have at least one port that is adapted to align with a channel formed in a wall of the bore when the sleeve moves. The actuating assembly may control a reamer, a stabilizer blade, a bladder, an in-line vibrator, an indenting member in a drill bit, or combinations thereof.

The actuating assembly may comprise a collar with a guide slot around a cam shaft with a pin or ball extending into the slot. When the collar moves axially, the cam rotates due to the interaction between the pin or ball and the slot. The cam shaft may be adapted to activate a switch plate, which is adapted to engage a plurality of gears. The actuating assembly may comprise at least one solenoid adapted to move a translation member in communication with a switching mechanism.

In some embodiments, the actuating assembly comprises a switching mechanism adapted to rotate a gear set in multiple directions.

The clutch may be a centrifugal clutch adapted to rotate with the turbine. The clutch may have at least one spring loaded contact adapted to connect the clutch to the shaft. The actuating assembly may be triggered by an increase in a velocity at which the turbine rotates, a decrease in the rotational velocity of the turbine, or a combination thereof. In some embodiments, the clutch may be controlled by a solenoid. The clutch may also be controlled over a wired drill pipe telemetry system, a closed loop system, or combinations thereof.

In another aspect of the present invention, a downhole tool string component has at least a first end with an attachment to an adjacent tool string component and a second end spaced apart from the first end for attachment to another adjacent tool string component. The downhole tool string component includes a bore between the first end and the second end and a turbine disposed within the bore. A turbine is disposed within the bore, the turbine being in mechanical communication with a linear actuator that is aligned with a central axis of the tool string component.

DETAILED DESCRIPTION

Figure 1:
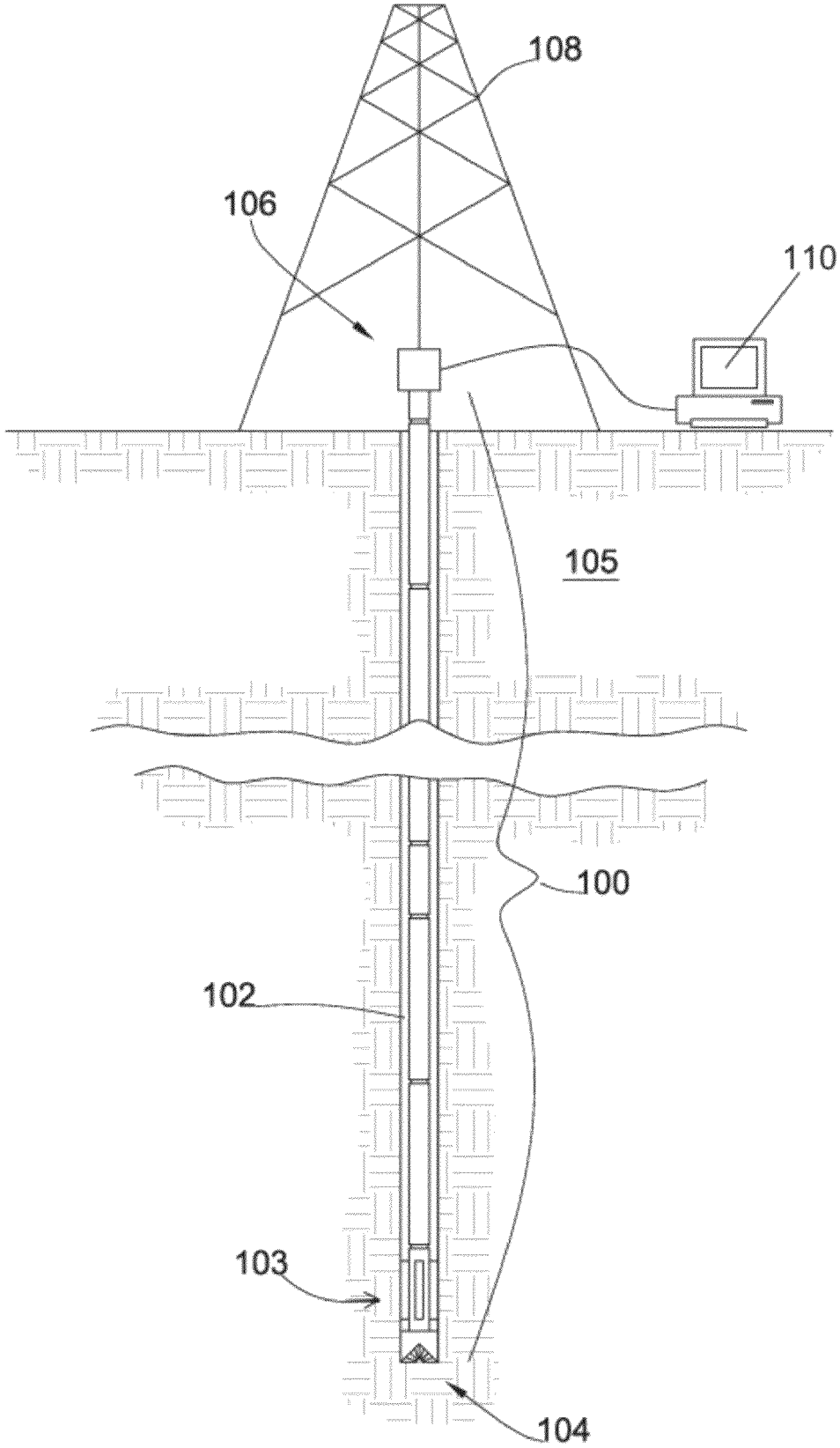
FIG. 1 is a perspective diagram of an embodiment of a drill string suspended in a borehole.

FIG. 1 is a perspective diagram of an embodiment of a drill string 100 suspended by a derrick 108 in a well-bore or bore hole 102. A drilling assembly 103 is located at the bottom of the bore hole 102 and comprises a drill bit 104. As the drill bit 104 rotates downhole the drill string 100 advances farther into the earth. The drill string 100 may penetrate soft or hard subterranean formations 105. The drilling assembly 103 and/or downhole components may comprise data acquisition devices adapted to gather data. The data may be sent to the surface via a transmission system to a data swivel 106. The data swivel 106 may send the data to the surface equipment 110. Further, the surface equipment 110 may send data and/or power to downhole tools, the drill bit 104, and/or the drilling assembly 103.

Figure 2A:
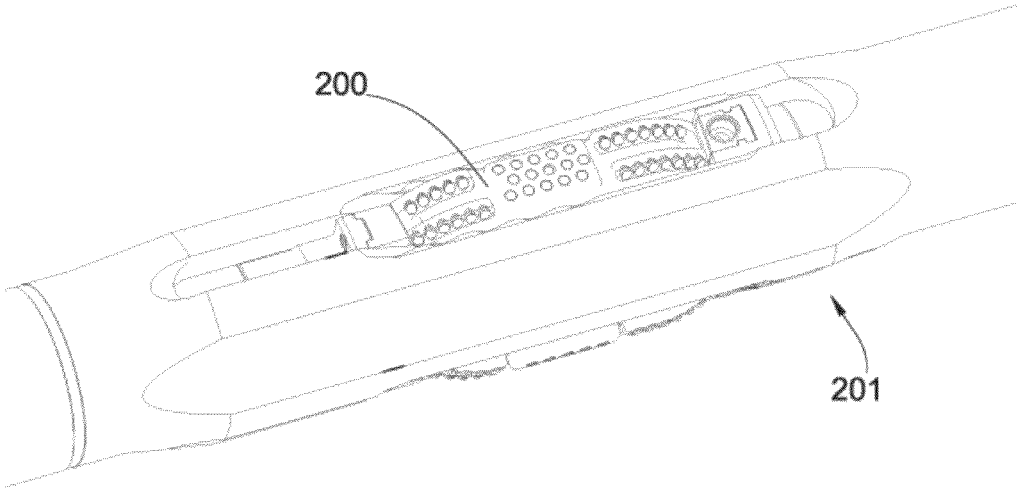
FIG. 2*a* is a perspective diagram of a portion of an embodiment of a tool string component that includes a reamer.

FIG. 2*a* is a perspective diagram of a portion of an embodiment of a downhole drill or tool string component 201 with a reamer 200. The reamer 200 may be adapted to extend into and retract away from a borehole wall. While against the borehole wall, the reamer 200 may be adapted to enlarge the diameter of the borehole larger than accomplished by the drill bit 104 at the front of the drilling assembly 103, as illustrated in FIG. 1.

Figure 2B:
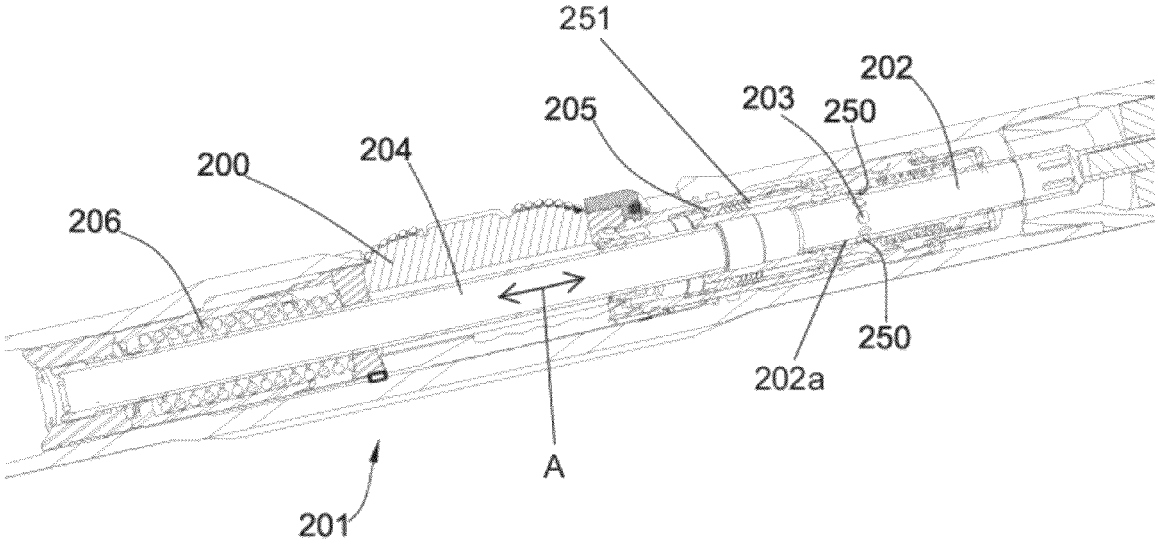
FIG. 2*b* is a cross-sectional diagram of the embodiment of the tool string component illustrated in FIG. 2*a*.

FIG. 2*b* is a cross-sectional diagram of the embodiment of the reamer 200 illustrated in FIG. 2*a*. A sleeve 202 located within a bore 204 of the tool sting component 201 may comprise ports 203. The ports 203 may be adapted to divert drilling mud that flows through the bore 204 when the ports 203 are aligned with openings 250 formed in a wall 202*a* of the bore 204. The diverted drilling mud may engage a piston 205 located in a chamber 251 otherwise isolated from the bore 204 when the ports 203 are not aligned with the openings 250; after the drilling mud passes through the chamber 251 the drilling mud is re-diverted back into the bore 204 of the tool string component 201. As the drilling mud urges the piston 205 to extend, it may push the reamer 200 outward. A ramp formed in the reamer 200 may cause the reamer 200 to extend radially the piston 205 applies an axial force to the reamer 200. The piston 205 and reamer 200 may stay extended by a dynamic force from the flowing drilling mud. The reamer 200 may be in mechanical communication with a spring 206 or other urging mechanism adapted to push the reamer 200 back into a retracted position in the absence of axial force exerted by the piston 205 while drilling mud is diverted into the chamber 251. A reamer that may be compatible with the present invention, with some modifications, is disclosed in U.S. Pat. No. 6,732,817 assigned to Smith International, Inc., which is herein incorporated by reference for all that it contains.

When the sleeve 202 is moved along direction A such that the ports 203 and openings 250 misalign, the dynamic force provided by the flowing drilling mud is cut off and the reamer 200 retracts. In other embodiments, a pause in drilling mud flow may also cause the reamer 200 to retract. The sleeve 202 may be moved to realign and misalign the ports 203 with the openings 250 on command to control the position of the reamer 200. In some embodiments, the ports 203 of the sleeve 202 is adapted to partially align with the openings 250, allowing a flow less than a flow through fully aligned ports 203 to engage the piston 205, thereby extending the reamer 200 less than its maximum radial extension. Further discussion and explanation of the mechanical structure and the process is made below in a discussion of FIGS. 8*a* and 8*b*.

Figure 3:
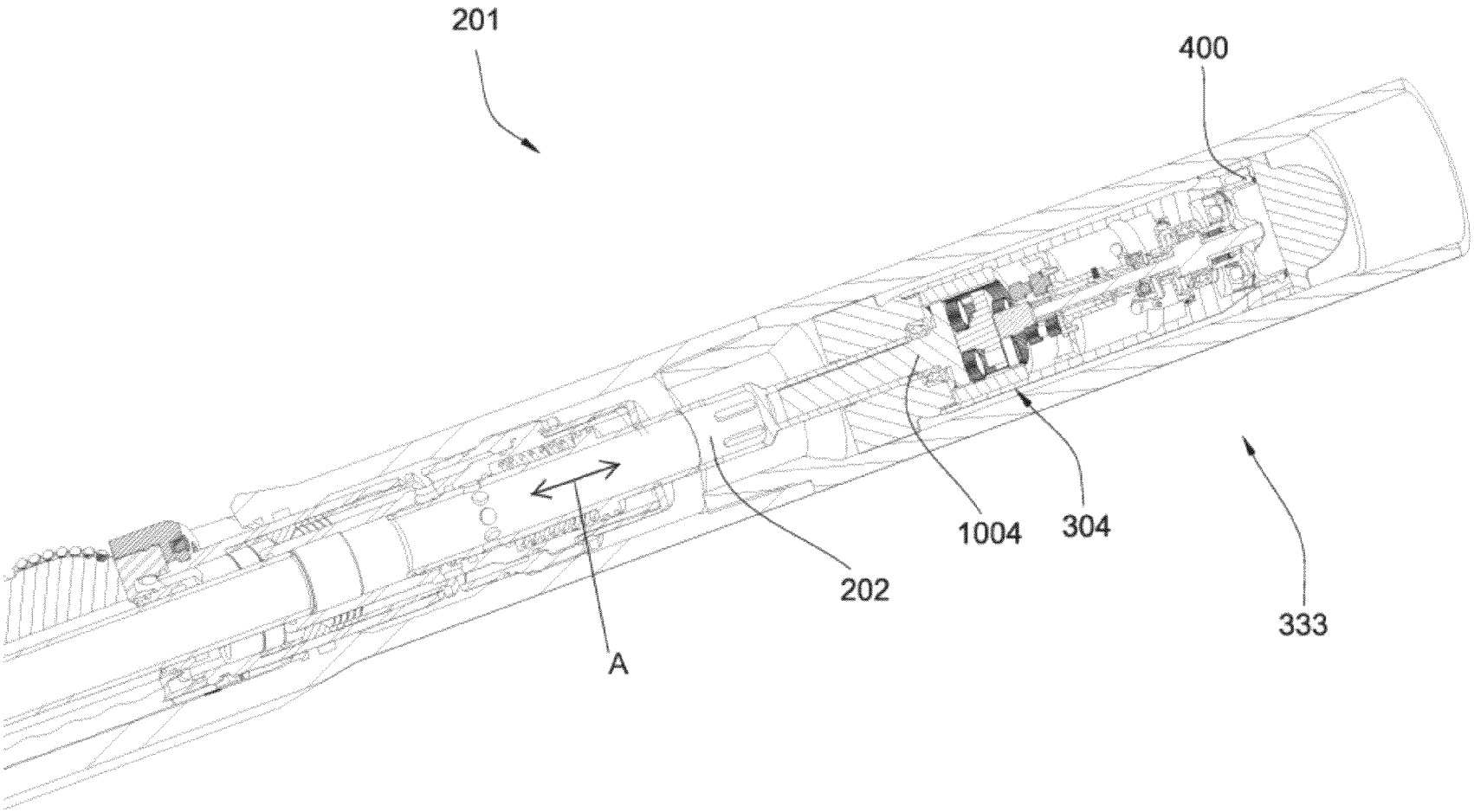
FIG. 3 is a cross-sectional diagram of another portion of the embodiment of the tool string component illustrated in FIG. 2*a*.

FIG. 3 is a cross-sectional diagram of another portion of the embodiment of the downhole drill string component 201. The drill string component 201 may comprise an actuating assembly 333 adapted to move the sleeve 202 axially along direction A. In some embodiments, the actuating assembly 333 is a linear actuator. The drill string component 201 may also comprise a turbine 400 in mechanical communication with the actuation assembly 333 wherein the turbine 400 may be involved in triggering and/or powering the actuation assembly 333. The actuation assembly 333 may engage or disengage a plurality of gears 304, such as a planetary gear system, adapted to move a linear screw member 1004 connected to the sleeve 202.

Figure 4:
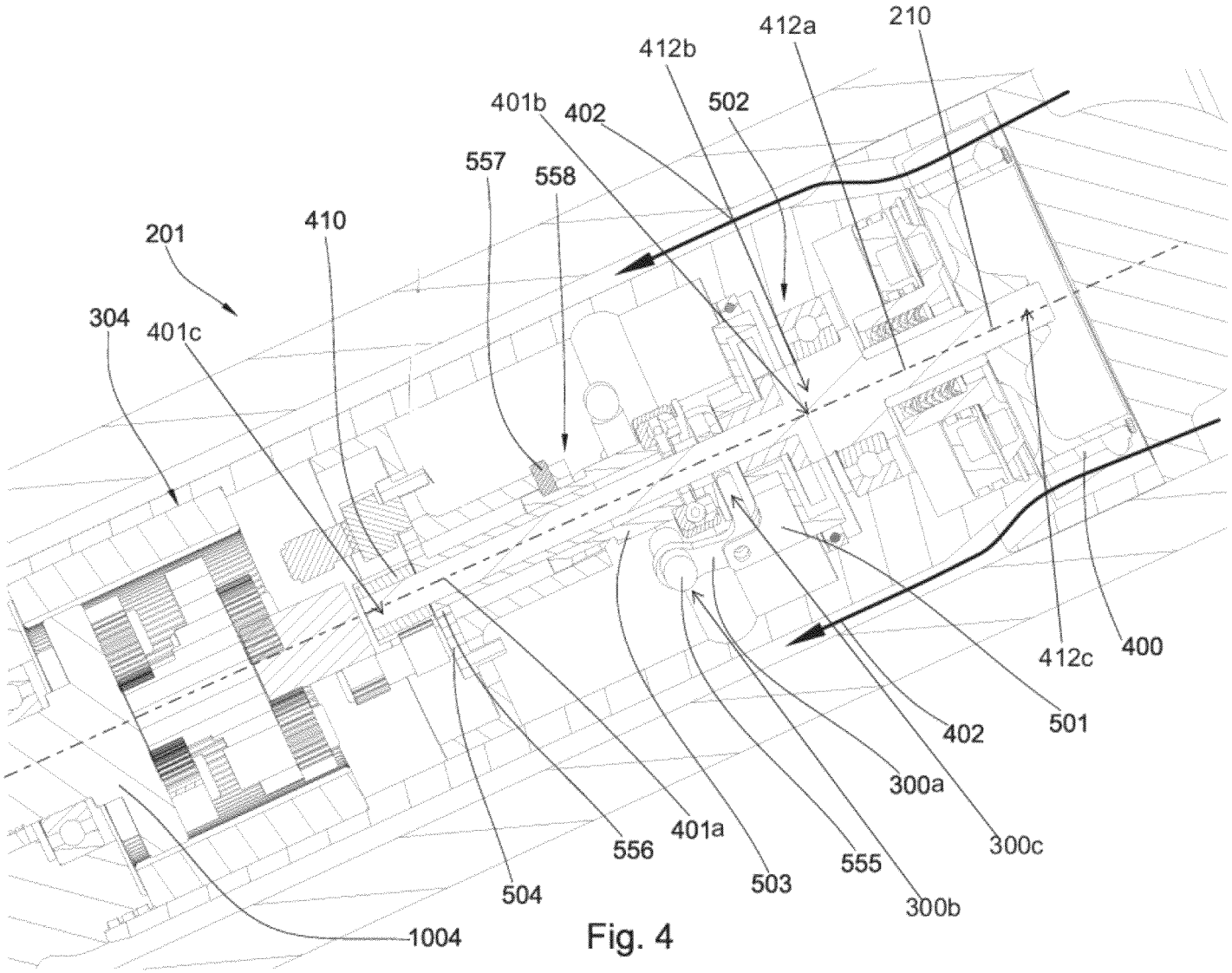
FIG. 4 is a close-up cross-sectional diagram of the another portion of the embodiment of the downhole tool string component illustrated in FIG. 3.
Figure 5:
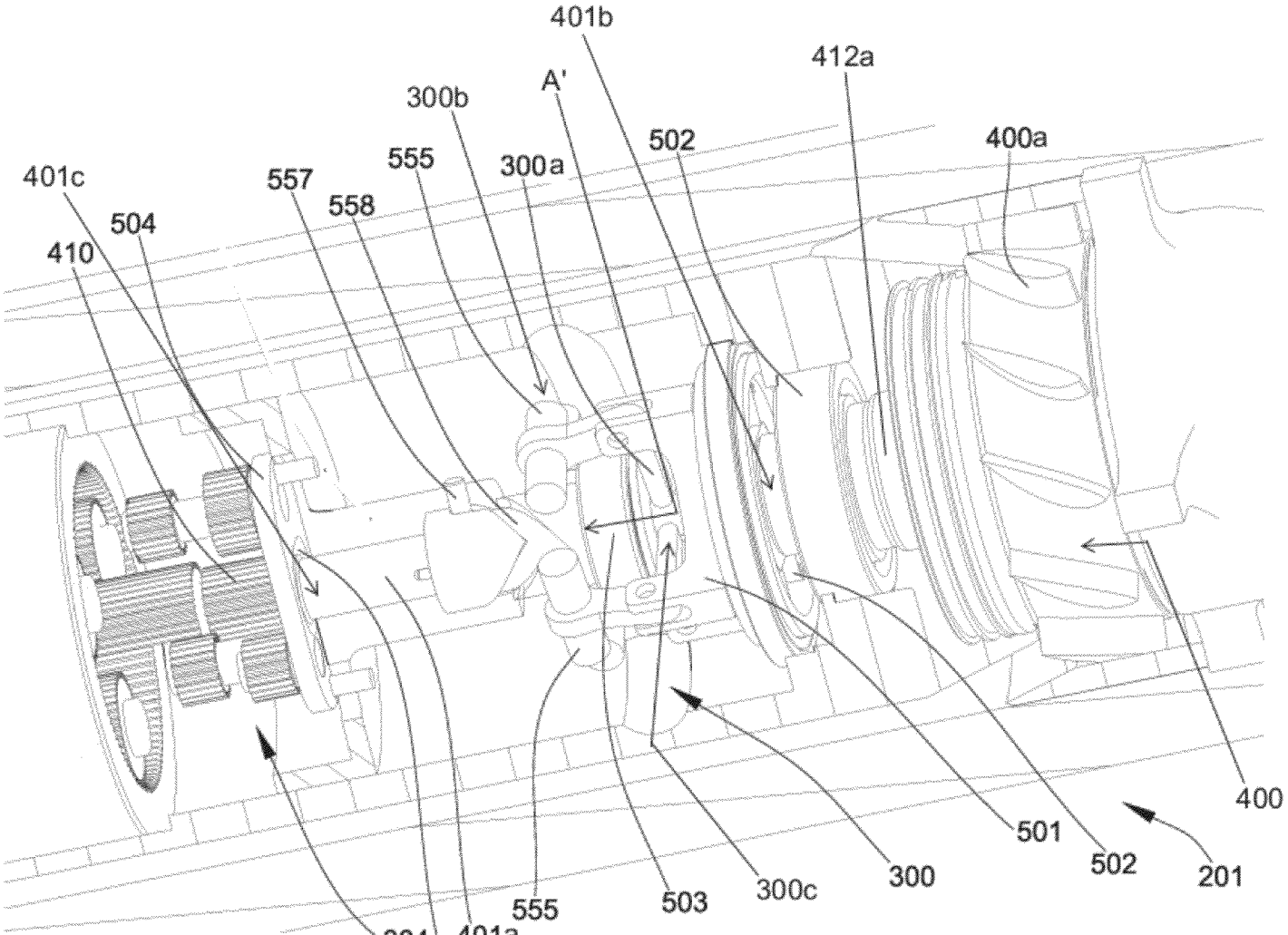
FIG. 5 is a close-up perspective diagram of the another portion of the embodiment of the downhole tool string component illustrated in FIG. 4.

FIGS. 4 and 5 disclose a turbine 400 located in the bore 204 of the drill string component 201. As drilling mud is passed along a fluid path 402 in the drill string component 201, the drilling mud flowing over one or more blades 400*a*, illustrated in FIG. 5, of the turbine 400, thereby rotating the turbine 400.

The turbine 400 is mechanically coupled to a shaft 412*a* at a proximal end 412*b* of the shaft 412*a*. The shaft 412*a* is mechanically coupled to a centrifugal clutch 502 at a distal end 412*c* of the shaft 412*a*. When drilling mud causes the turbine 400 to rotate, thereby rotating the shaft 412*a*, the centrifugal clutch 502 also rotates. Once the centrifugal clutch 502 rotates sufficiently fast, the centrifugal clutch 502 engages a mount 501, causing the mount 501 to rotate with the turbine 400. (The operation of the centrifugal clutch is discussed in further detail below and in reference to FIGS. 11*a* and 11*b*.) As the mount 501 rotates, a plurality of weights 555 attached to a distal end 300*b* of a pivotally attached bracket 300*a* may be forced outward away from a central axis 210 of the drill string component 201 while a proximal end 300*c* of the bracket 300*a* moves to push in an axial direction A' on a collar 503 coupled to a proximal end 401*b* of a shaft 401*a* located below the mount 501. A driving gear 410 (FIG. 5) disposed on a distal end 401*c* of the shaft 401*a*. Thus, the turbine 400 is mechanically coupled through the shaft 412*a*, through a clutch 502, to the shaft 401*a*, and consequently the driving gear 410.

The collar 503 may comprise a guide pin 557 that interacts with a guide slot 558 formed in a cam housing. When the collar 503 moves in an axial direction A' it may rotate the cam 556. The rotation of the cam 556 may move a switch plate 504 adapted to selectively place the driving gear 410 in contact with a plurality of gears 304. When activated the plurality of gears 410 may transfer torque from the shaft 401*a* to a linear screw member 1004 (FIG. 4) attached to the sleeve 202, as illustrated in FIG. 3.

The guide slot 558 may comprise a section that causes the collar 503 to move in a first direction and another section that causes the collar 503 to move in a second direction away from the first direction. The direction that the collar 503 travels dictates how the driving gear 410 engages the plurality of gears 304. In a preferred embodiment, the plurality of gears 304 is a planetary gear system that may control the direction that the gears within the planetary gear system rotate. A clockwise or counterclockwise rotation of the gears determines the forward or backward axial movement A of the linear screw member 1004, as illustrated in FIG. 3.

Figure 6:
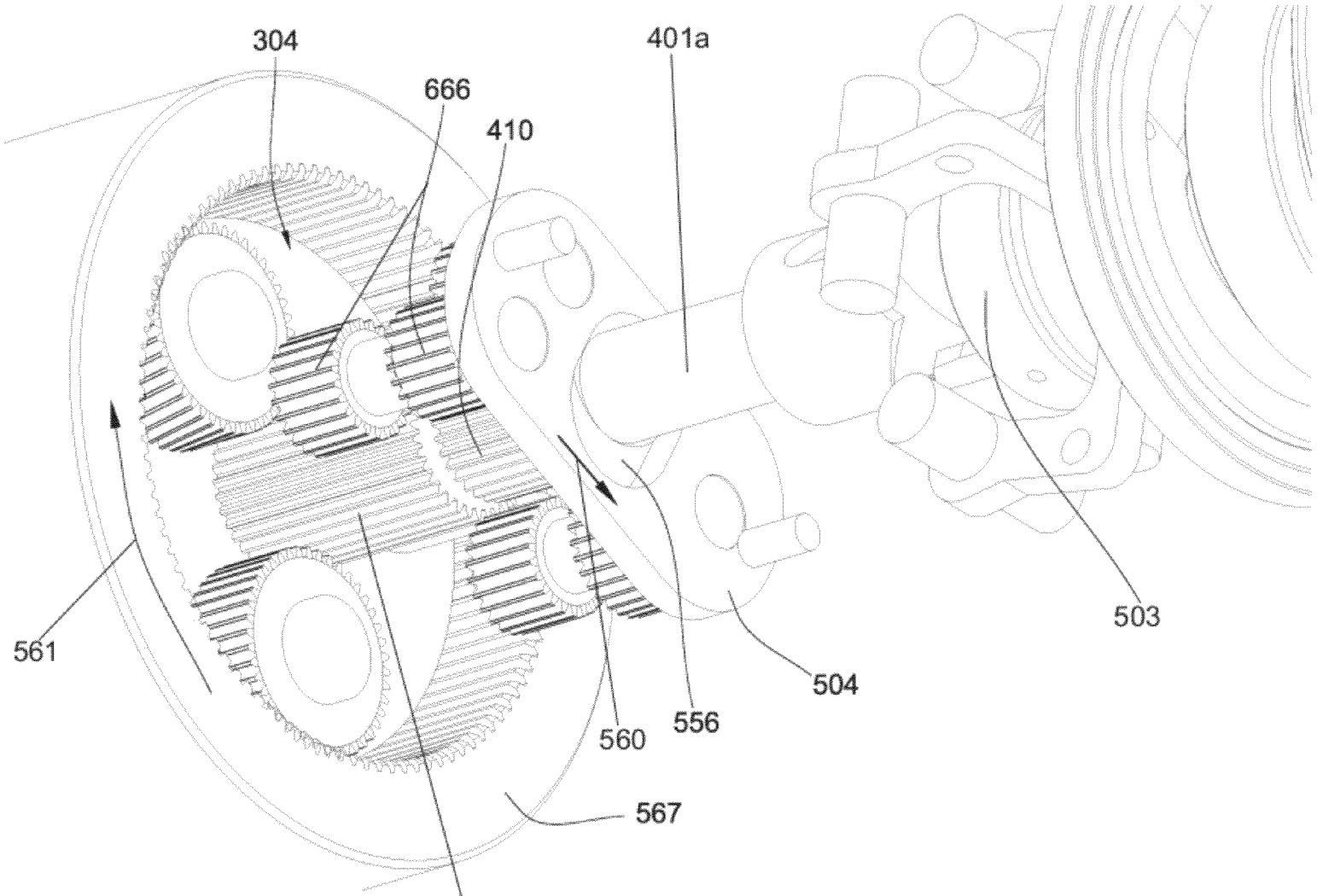
FIG. 6 is a perspective diagram of an embodiment of a switch plate for use in embodiments of the tool string component in a first position.

FIG. 6 discloses the switch plate 504 that moves the cam 556 in direction 560 as the collar 503 is advanced axially. The switch plate 504 may be positioned such that the driving gear 410 becomes engaged with a first set of gears 666 mounted to the switch plate 504, thereby engaging the plurality of gears 304. The engagement of the plurality of gears 304 may rotate a circular rack 567 in a direction 561 that drives a secondary gear set 678 adapted to turn the linear screw member 1004, as illustrated in FIG. 3.

As discussed above and in reference to FIGS. 4 and 5, a decrease or slowing of the flow rate of the drilling mud and, consequently, the turbine 400 may cause the centrifugal clutch 502 to decouple the shaft 412*a* from the shaft 401*a*. When this occurs, the collar 503, which may be in communication with a spring (not shown) adapted to urge the collar 503 back to its original axial position, moves axially towards the centrifugal clutch 502, thereby disengaging the driving gear 410 from the plurality of gears 304. With the driving gear 410 disengaged from the plurality of gears 304, the plurality of gears no longer drive the linear screw member and the secondary gear set 678 and, consequently, the linear screw member 1004 remains in its last position before the plurality of gears were disengaged.

Figure 7:
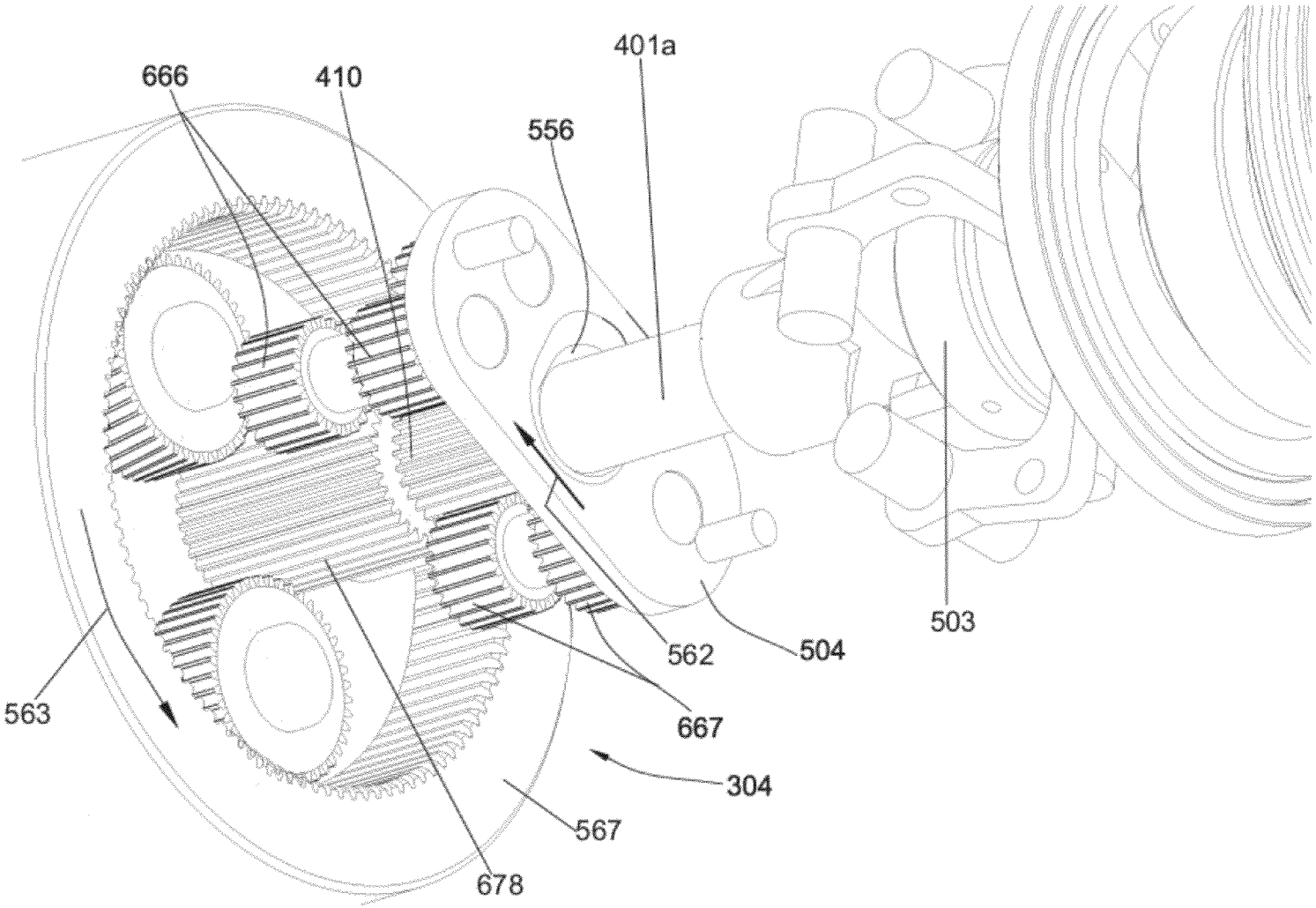
FIG. 7 is a perspective diagram of the embodiment of the switch plate illustrated in FIG. 6 in a second position.

Referring now to FIG. 7, should the flow of the drilling mud subsequently increase and, in turn, causing the rotational velocity of the turbine 400 and the shaft 412*a* coupled thereto to increase, the centrifugal clutch 502 will recouple the shaft 412*a* with the shaft 401*a*. This causes the collar 503 to re-interact with the pin 557 in its guide slot 558. The guide slot 558 is formed such that it will cause the cam 556 to push the driving gear 410 in a direction 562 into a position that causes the driving gear 410 to engage with a second set of gears 667 mounted to the switch plate 504, thereby engaging the plurality of gears 304. The engagement of the plurality of gears 304 may rotate a circular rack 567 in a direction 563 that drives a secondary gear set 678 to retract the linear screw member 1004, as illustrated in FIG. 3. Thus, the sleeve 202 (shown in FIG. 2*b*) attached to the linear screw member 1004 may be moved to extend or retract the reamer 200.

Figure 8A:
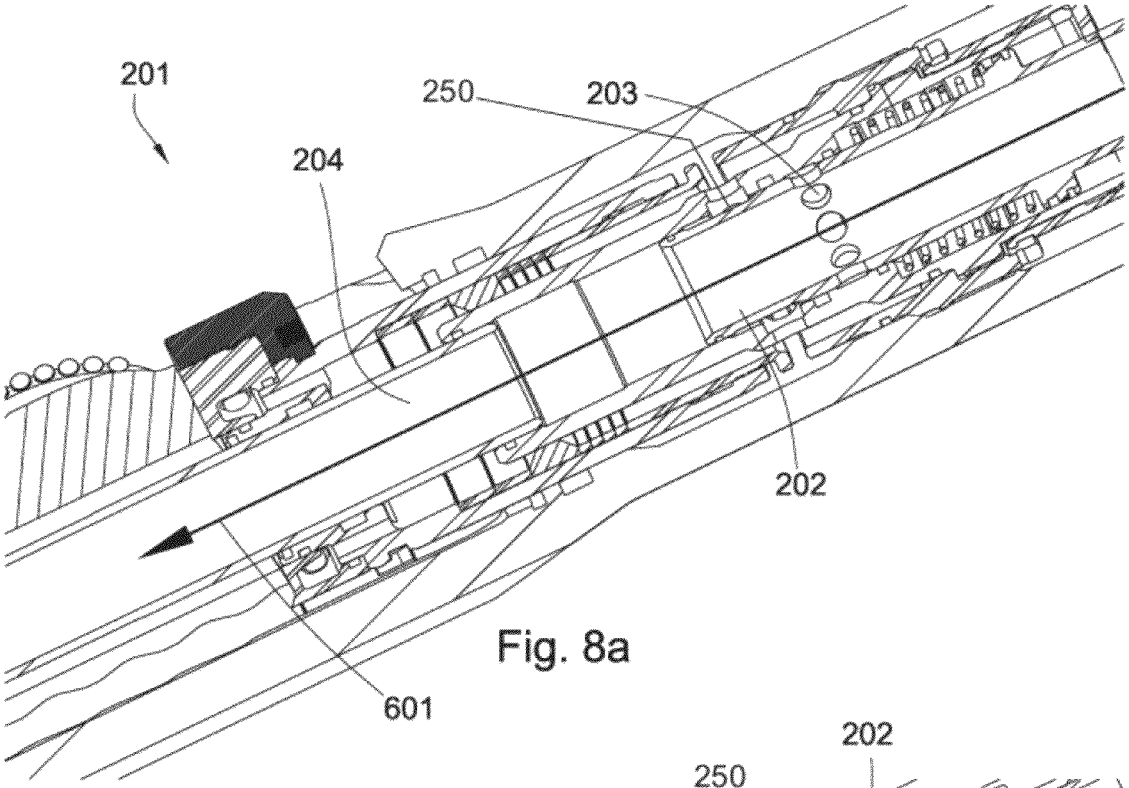
FIG. 8*a* is a close-up cross-sectional diagram of the portion of the embodiment of the downhole tool string component illustrated in FIG. 2*b* in which a sleeve is in a first position.

FIG. 8*a*, and in reference to FIG. 2*b* and the related text, discloses an arrow 601 indicating the drilling mud flow through the bore 204 of the drill string component 201 when the ports 203 of the sleeve 202 are misaligned with the openings 250, thereby preventing the flow of the drilling mud through the openings 250.

Figure 8B:
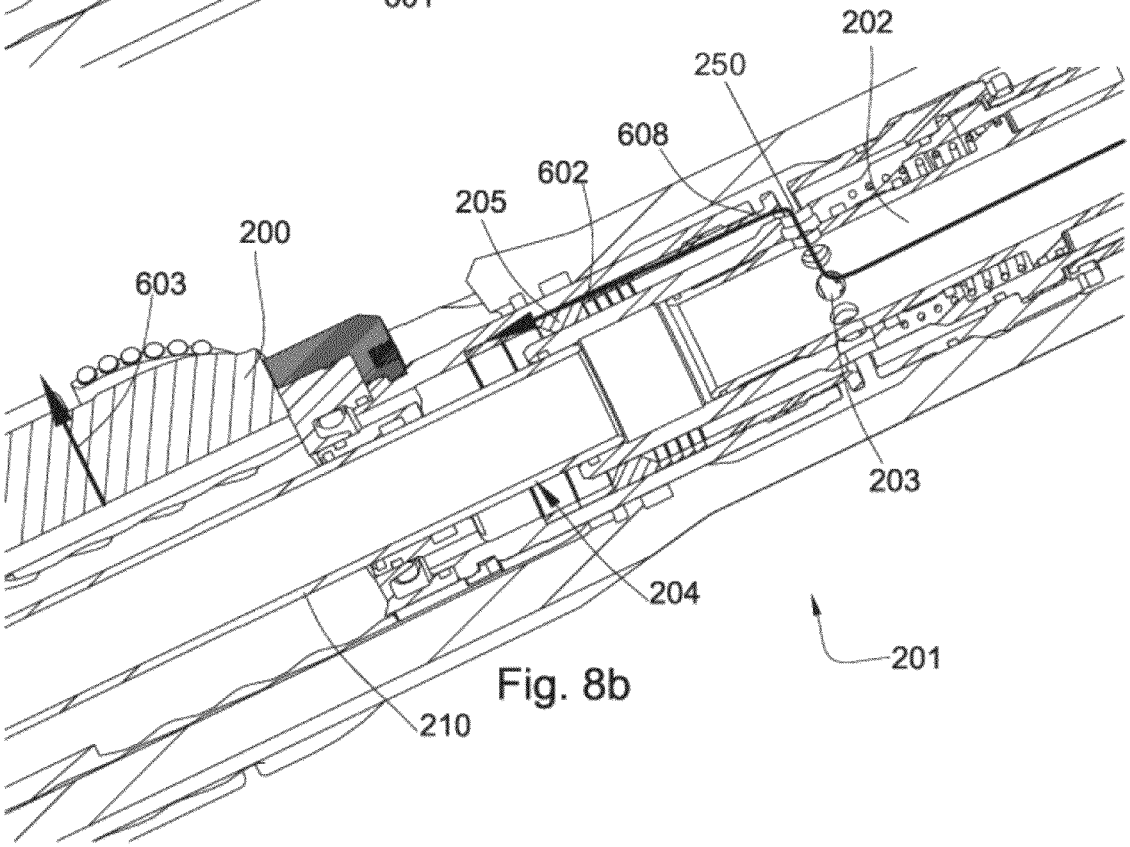
FIG. 8*b* is a close-up cross-sectional diagram of the portion of the embodiment of the downhole tool string component illustrated in FIG. 2*b* in which a sleeve is in a second position.

FIG. 8*b* discloses the ports 203 of the sleeve 202 aligned with the openings 250. In this instance, drilling mud is partially diverted along a path 602 through the openings 250 and into a channel 608 in which the piston 205 is disposed. The drilling mud engages the piston 205 as discussed above in reference to FIG. 2*b*, thereby causing the piston 205 to move the reamer 200 outward in a direction 603 due to an inclined ramp formed in the blade (discussed in relation to FIG. 2*b*).

Figure 9:
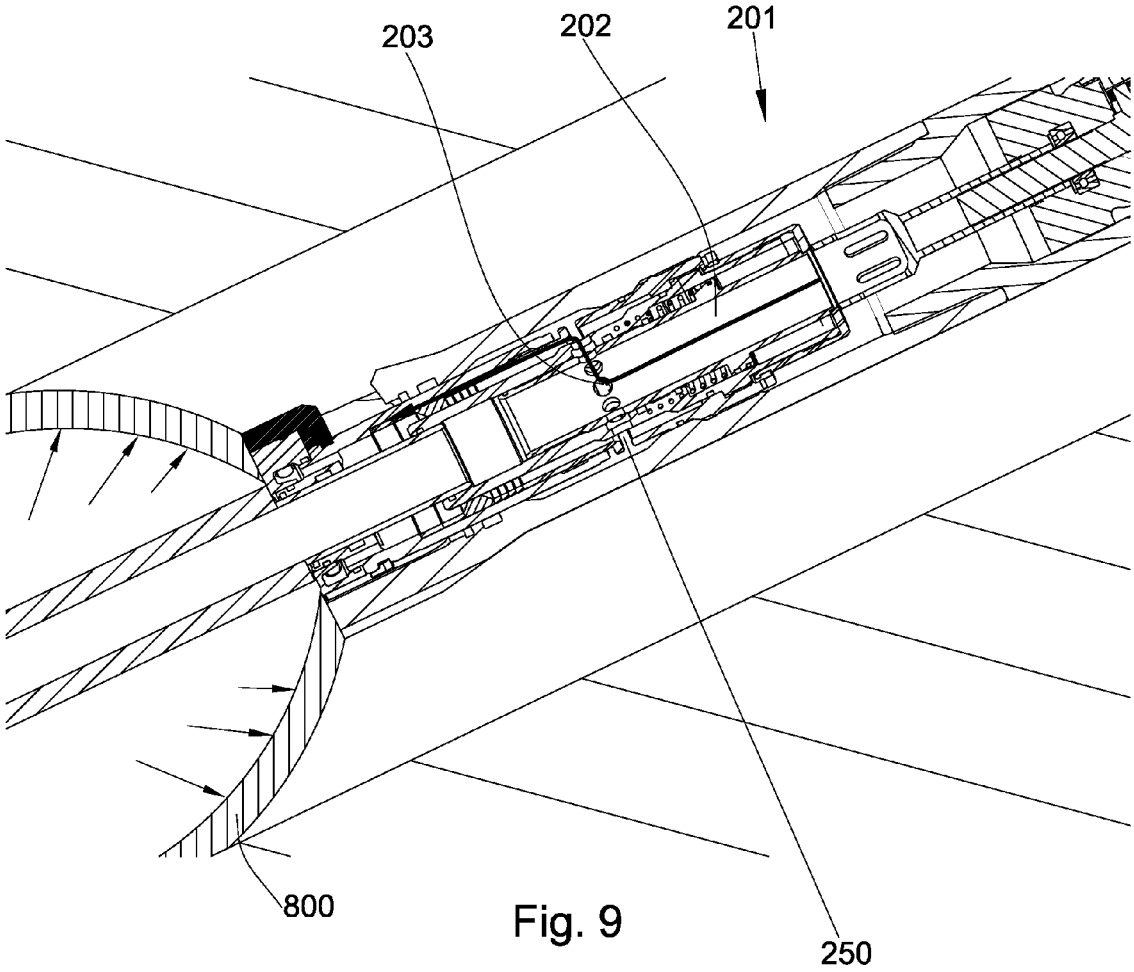
FIG. 9 is a cross-sectional diagram of an embodiment of a downhole tool string component that includes a packer.

FIG. 9 discloses a packer 800 that may be activated in a similar manner as the reamer described above.

Figure 10A:
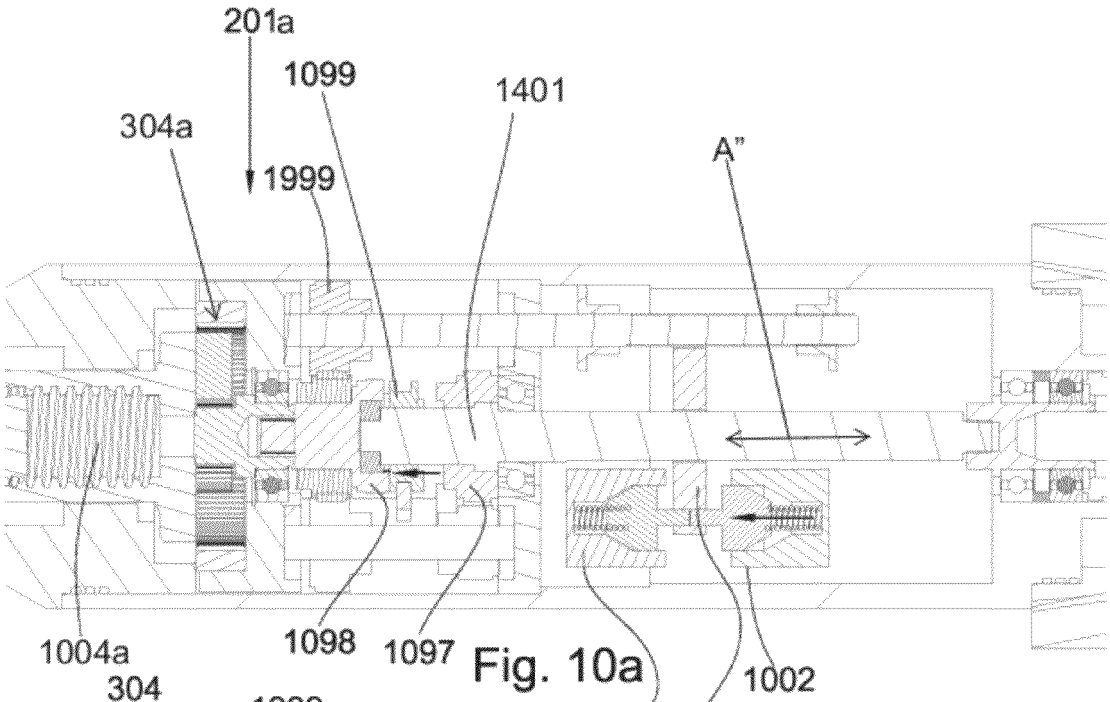
FIG. 10*a* is a cross-section of an embodiment of a downhole drill string component that includes a solenoid-activated clutch.
Figure 10B:
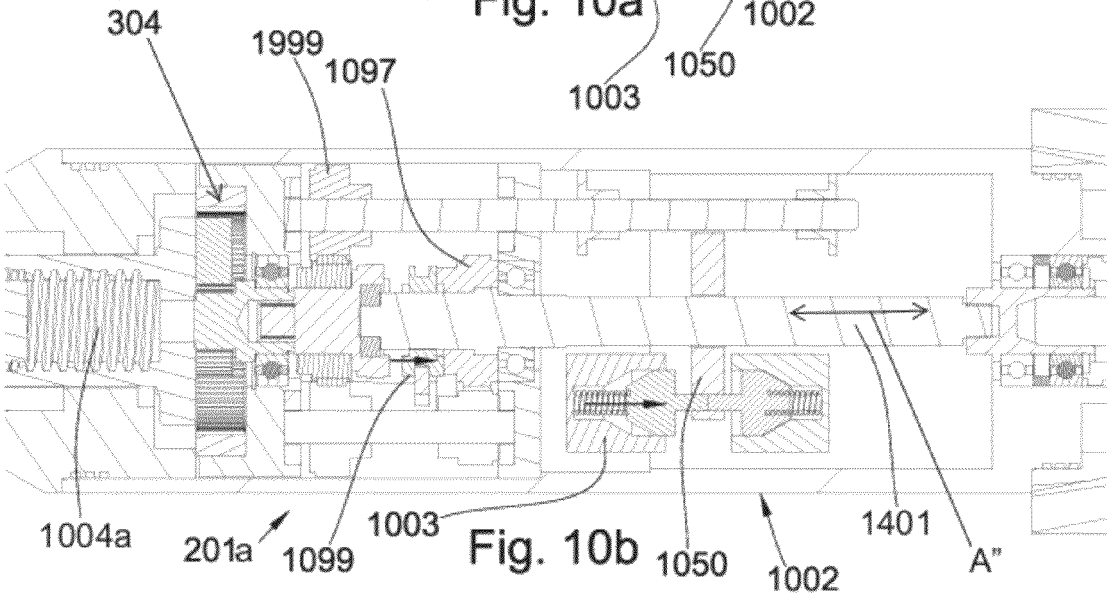
FIG. 10*b* is another cross-section view of the embodiment of a downhole drill string component that includes the solenoid-activated clutch illustrated in FIG. 10*b*.

FIGS. 10*a* and 10*b* are cross-sectional diagrams disclosing an embodiment of a downhole tool component 201*a* that includes a solenoid activated clutch. A first solenoid 1002 and a second solenoids 1003 that acts in a direction opposite of the first solenoid 1002 are in mechanical communication with a translation member 1050 mechanically coupled to a shaft 1401. The shaft 1401 is coupled to and rotated by a turbine, such as turbine 400 in FIG. 5 that is discussed above. The shaft 1401 is mechanically coupled to and, consequently, rotates a key gear 1099. As reference to the drawings makes clear, the key gear 1099 is mechanically coupled through the shaft 1401 to the translation member 1050. When the first solenoid 1002 is activated, it moves in a first axial direction A", thereby moving the shaft 1401 and the key gear 1099 in the same direction as the first solenoid 1002. When the second solenoid 1003 is activated (FIG. 10*b*), it moves in a second axial direction A" opposite the first axial direction, thereby moving the shaft 1401 and the key gear 1099 in the same direction as the second solenoid 1003. Depending on the direction, the key gear 1099 will engage either a forward gear 1098 or a reverse gear 1097, which will drive a plurality of gears 304*a*, such as the plurality of gears 304 discussed above in reference to FIGS. 4 and 5, to either extend or retract a linear screw member 1004*a*, as above. The translation member 1050 may comprise a length adapted to abut a barrier to control its travel. The translation member 1050 may be biased, spring-loaded, or comprise an urging mechanism adapted to return the translation member 1050, and, therefore, the key gear 1099, to an unengaged position when a solenoid, such as first solenoid 1002 or second solenoid 1003, is not energized.

The first solenoid 1002 and the second solenoid 1003 may be energized through either a local or remote power source. A telemetry system, such as provided by wired drill pipe or mud pulse, may provide an input for when to activate a solenoid. In some embodiments, a closed loop system may provide the input from a sensed downhole parameter and control the actuation.

Figure 11A:
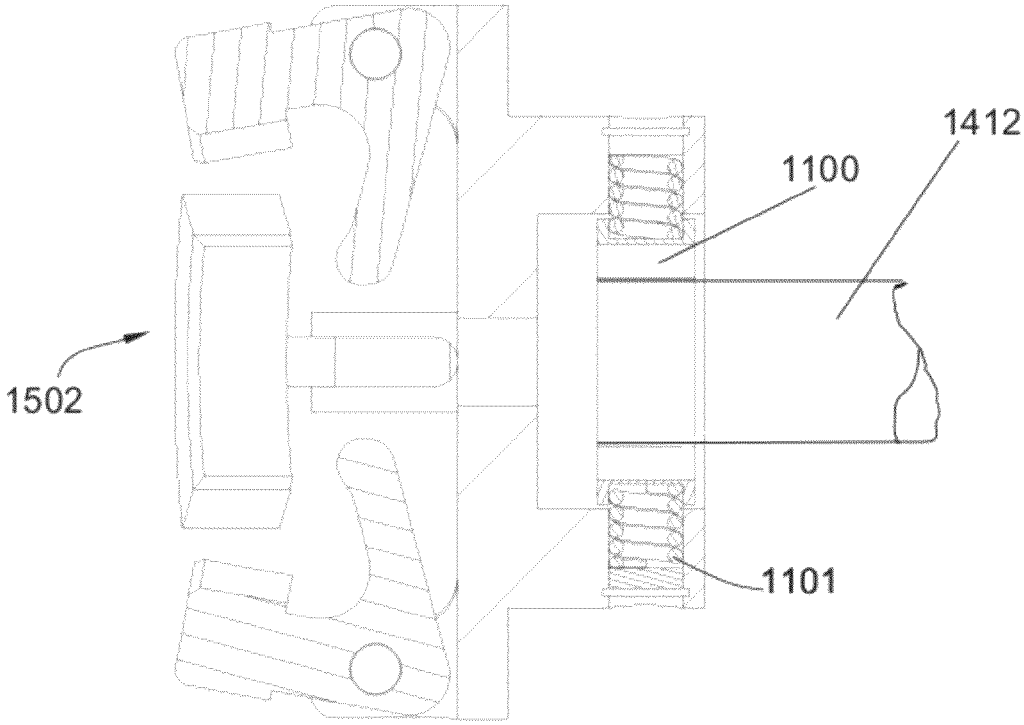
FIG. 11*a* is a cross-section of an embodiment of a centrifugal clutch.
Figure 11B:
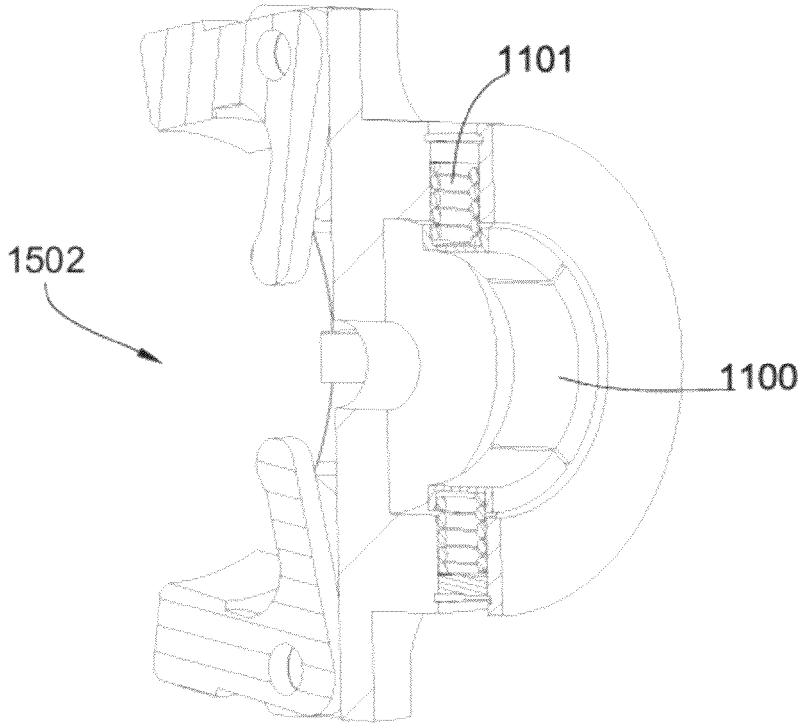
FIG. 11*b* is a perspective cut-away of the embodiment of the centrifugal clutch illustrated in FIG. 11*a*.

FIGS. 11*a* and 11*b* disclose an embodiment of a centrifugal clutch 1502, such as the centrifugal clutch 502 discussed above in association with FIGS. 4 and 5. The centrifugal clutch 1502 comprises grippers 1100 attached to springs 1101. In this embodiment, when the centrifugal clutch 1502 rotates sufficiently fast a centrifugal force may overcome the spring force and move the grippers 1100 away from a shaft 1412. At lower rotational velocities the grippers 1100 bear down on the shaft 2401 rotationally locking them together. To engage the centrifugal clutch 1502 the flow of the drilling mud may be reduced; and to disengage the centrifugal clutch 1502 the flow may be increased.

Figures 12A, 12B:
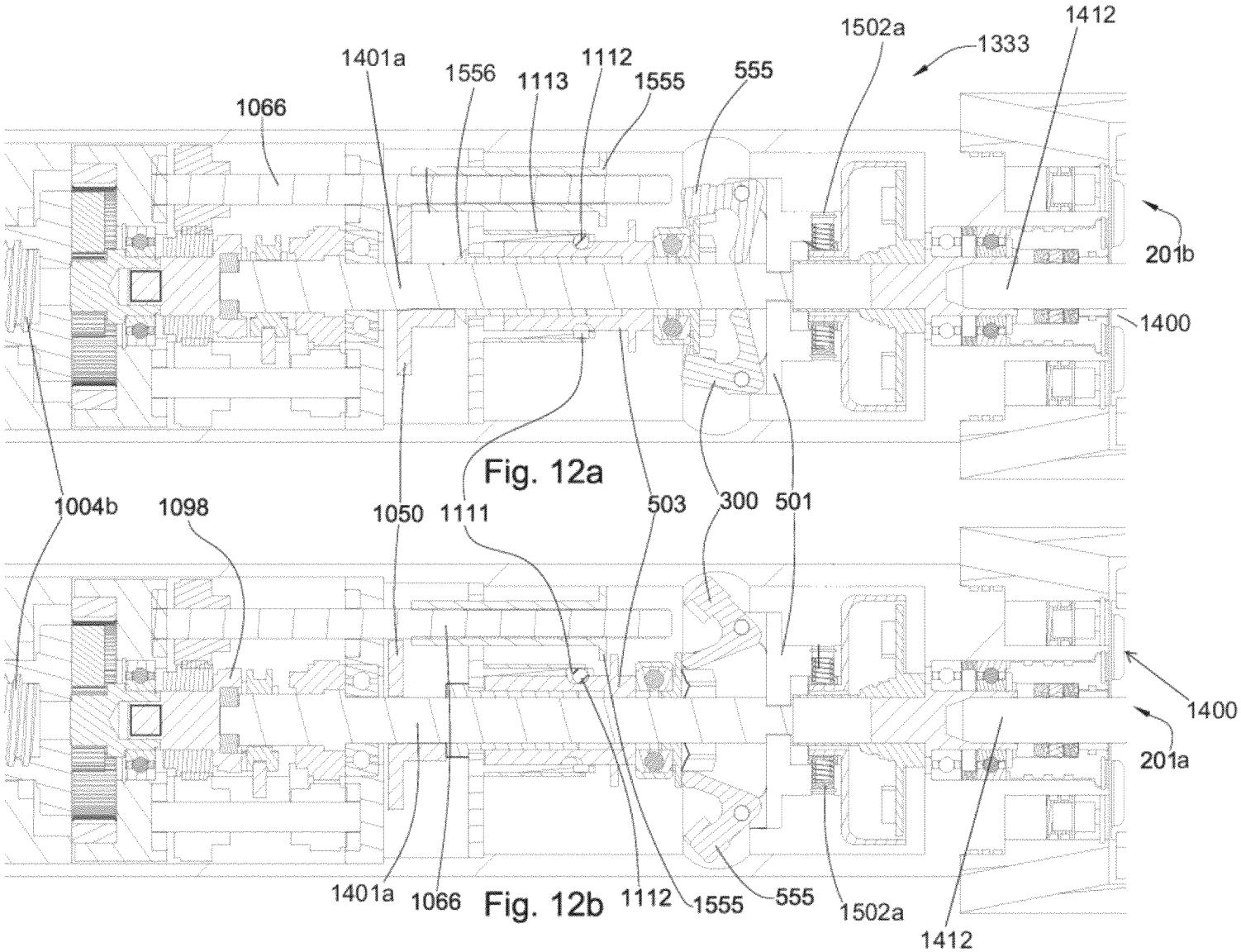
FIG. 12*a* is a cross-section diagram of an embodiment of a downhole drill string component that includes an actuation assembly.
FIG. 12*b* is a cross-section diagram of the embodiment of the downhole drill string component that includes the actuation assembly illustrated in FIG. 12*a*.

FIGS. 12*a* and 12*b* disclose an embodiment of portion of a downhole drill string component 201*b* that includes an actuation assembly 1333 comprising a turbine 1400 connected to a shaft 1412. When a centrifugal clutch 1502*a* is engaged as described above in reference to FIGS. 11*a* and 11*b*, the collar 1503 may be pushed forward in a similar manner as described above in reference to FIGS. 4 and 5. In this embodiment, the collar 1503 may comprise a ball track 1111 adapted to receive a ball 1112 in communication with a cam 1556. As the collar 1503 is pushed down, the cam 1556 rotates, which moves a translation member 1050*a*. Movement of the translation member causes a key gear 1099*a* coupled to a shaft 1401*a* to engage with either a forward gear 1098*a* or a reverse gear 1097*a* as described above in reference to FIGS. 10*a* and 10*b*, which in turn either advances or retracts a linear screw member 1004*b*.

Figure 13A:
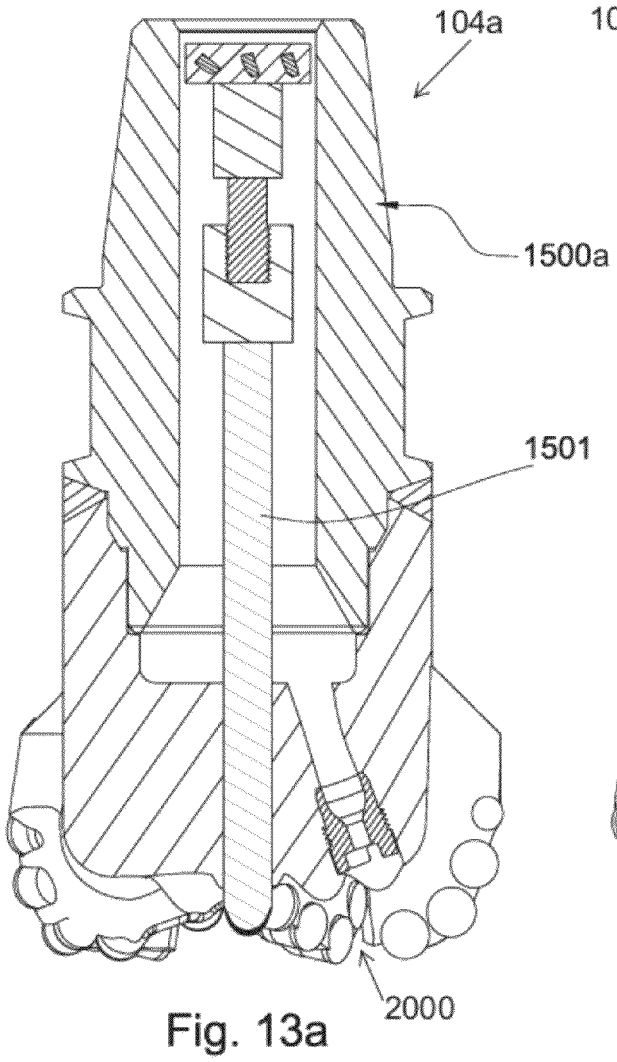
FIG. 13*a* is a cross-sectional diagram of an embodiment of a drill bit.

FIG. 13*a* is a cross-sectional diagram of an embodiment of a drill bit 104*a*. The drill bit 104*a* may comprise an actuating assembly 1500*a* patterned after those described above. The assembly 1500 may be adapted to axially move an indenting member 1501 towards a cutting surface 2000 of the drill bit 104*a*. The indenting member 1501 may be a steerable element, hammer element, penetration limiter, weight-on-bit controller, sensor, probe, or combinations thereof.

Figure 13B:
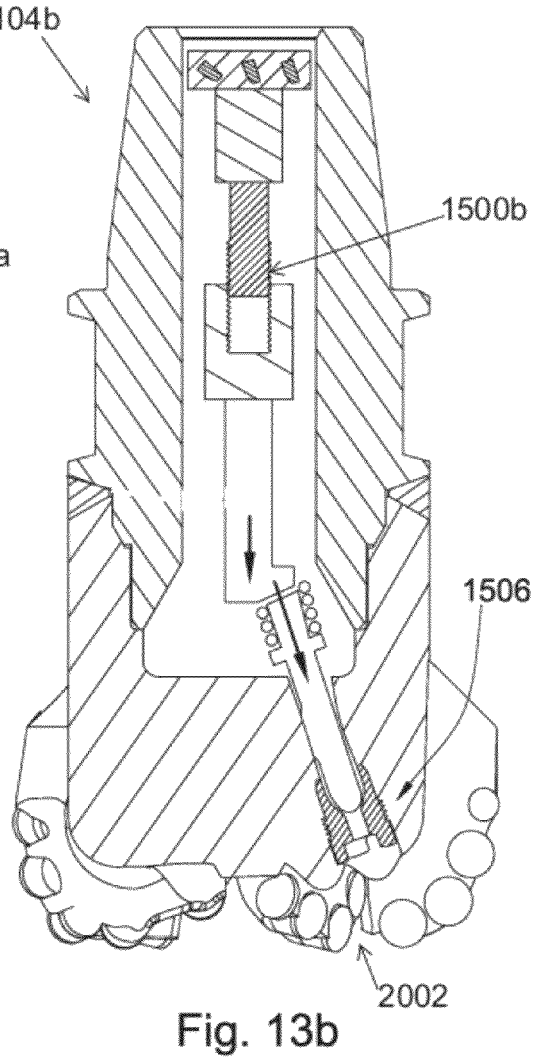
FIG. 13*b* is a cross-sectional diagram of another embodiment of a drill bit.

In the embodiment of a drill bit 104*b* illustrated in FIG. 13*b*, an actuating assembly 1500*b* may be use to control a flow of drilling mud through a nozzle 1506 disposed in a face 2002 of the drill bit 104*b*.

Figure 14:
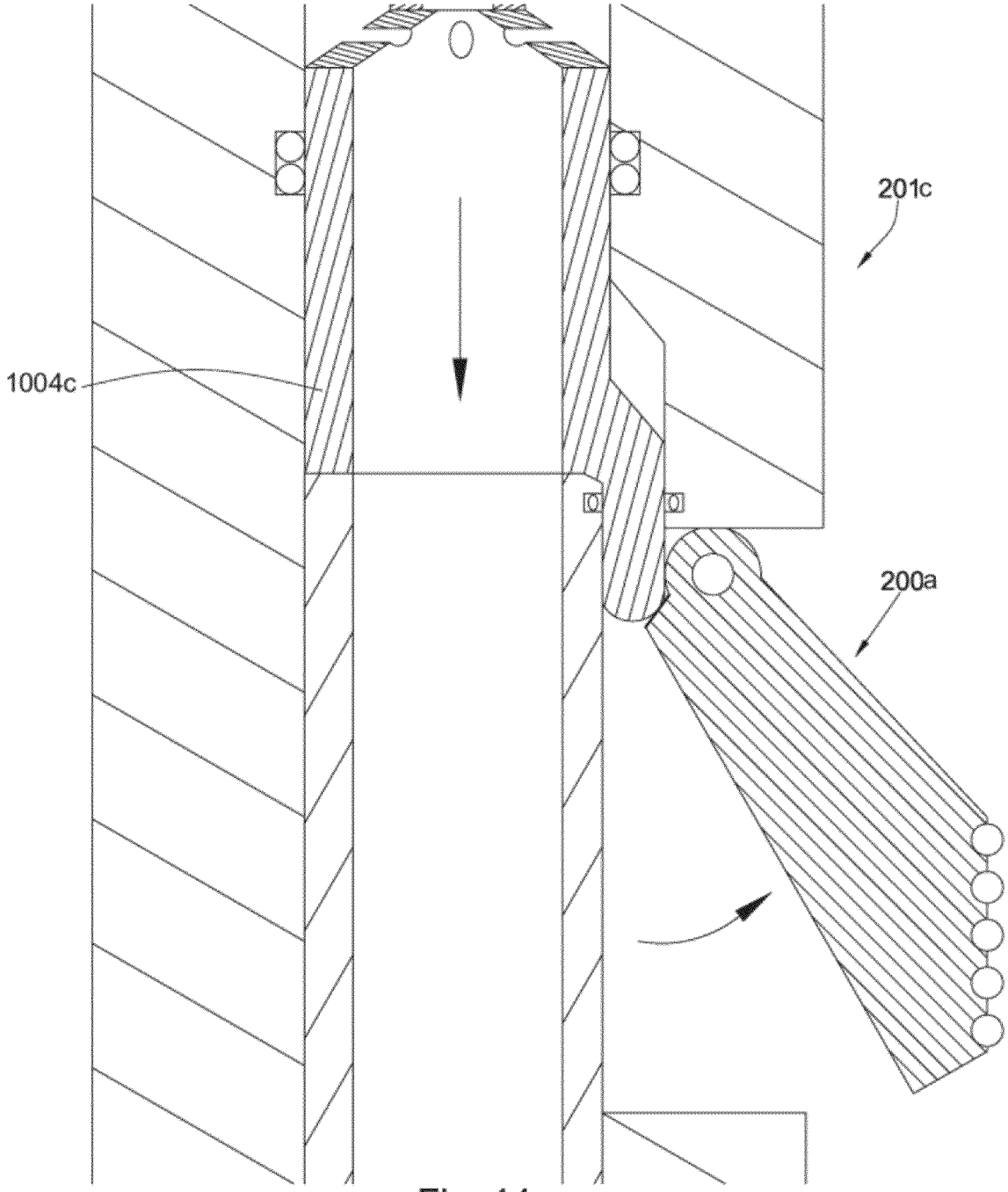
FIG. 14 is a cross-sectional diagram of an embodiment of a reamer.

FIG. 14 is a cross-sectional diagram of an embodiment a downhole drill string component 201*c* that includes a winged reamer 200*a*, which may be pivotally extended away from downhole drill string component 201*c* by using a linear screw member 1004*c*.

Figure 15:
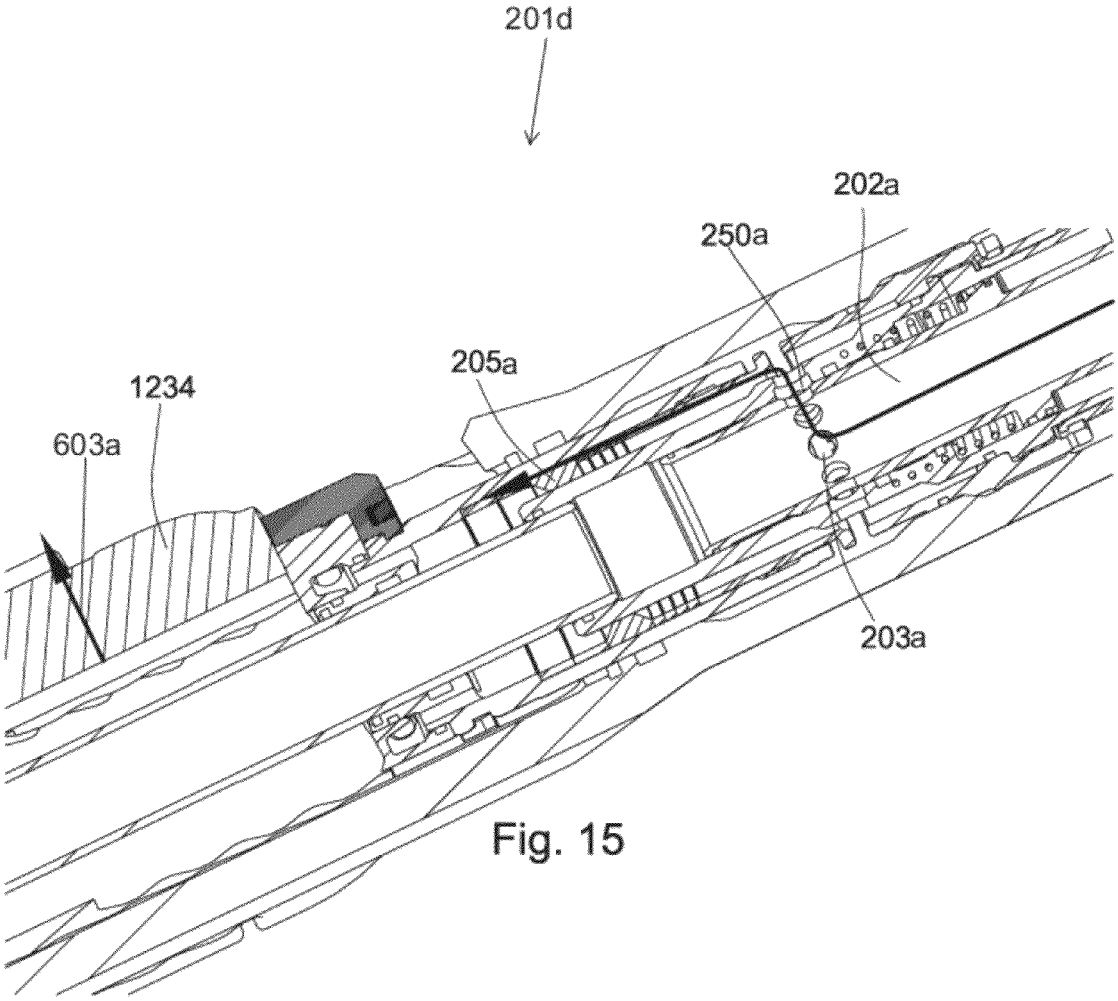
FIG. 15 is a cross-sectional diagram of an embodiment of a stabilizer in a drill string component.

FIG. 15 discloses an embodiment of a downhole drill string component 201*d* that includes an actuation mechanism adapted to extend a stabilizer blade 1234. As ports 203*a* in a sleeve 202*a* align with a plurality of openings 250*a*, the flow of a drilling mud may be partially diverted to engage a piston 205*a* adapted to push the stabilizer 1234 in a direction 603*a* towards a formation.

Figure 16:
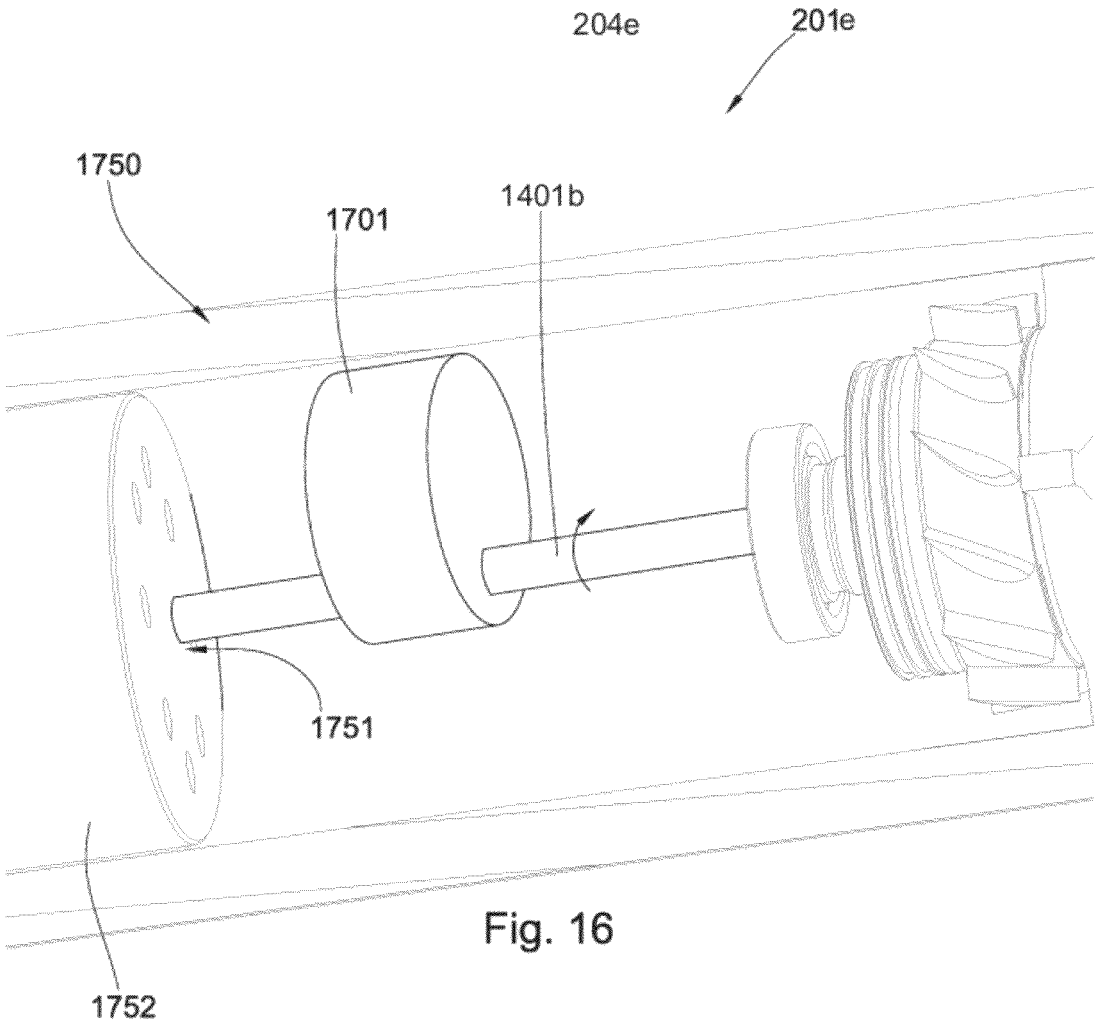
FIG. 16 is a perspective diagram of an embodiment of a vibrator.

FIG. 16 discloses an embodiment of a downhole drill string component 201*e* that includes an in-line vibrator 1750 disposed within a bore 204*e* of the drill string component 201*e*. As a shaft 1401*b* rotates due to activation of a clutch (not illustrated), an off-centered mass 1701 coupled to the shaft 1401*b* is rotated. The in-line vibrator 1701 may reduce the drilling industry's dependence on drilling jars which violently shake the entire drill string when the drill string gets stuck in a well-bore. The in-line vibrator 1701 may successfully free the downhole drill string component 201*e* and the drill string while using less energy than traditional jars. This, in turn, may preserve the life of the drill string components and its associated drilling instrumentation. In some embodiments, the use of the in-line vibrator 1701 may prevent the drill string from getting stuck in the well-bore in the first place. The distal end 1751 of the shaft 1401*b* may be supported by a spider 1752.

Figure 17:
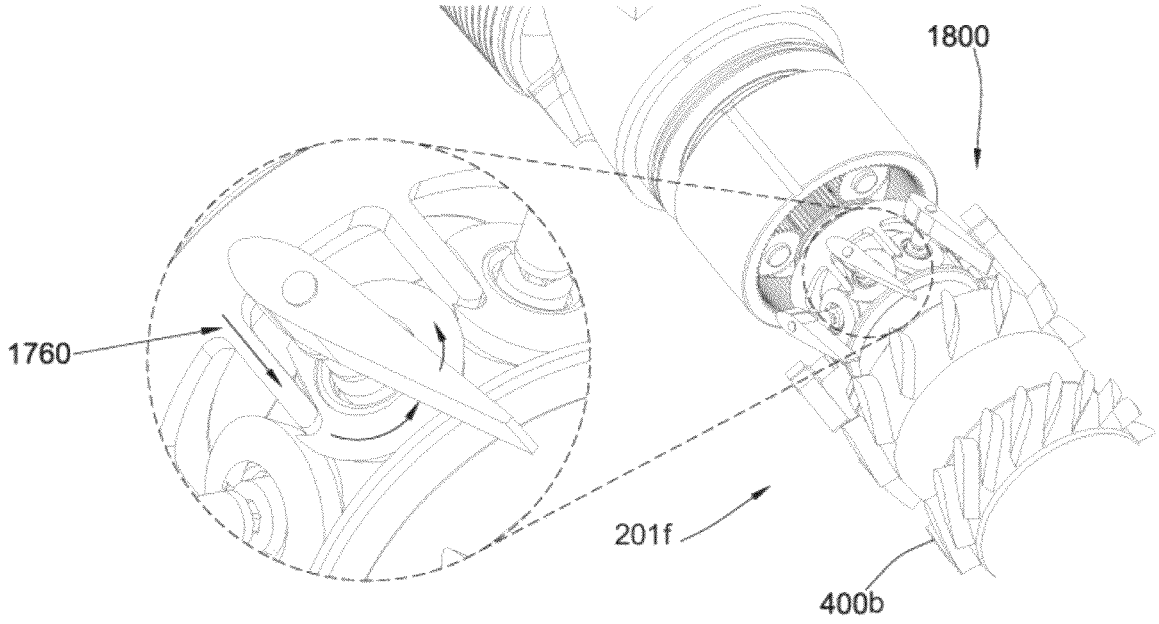
FIG. 17 is a perspective diagram of an embodiment of a turbine for use in a downhole tool string component.

FIG. 17 discloses an embodiment of a downhole drill string component 201*f* that includes a turbine 400*b* with adjustable blades 1760. A solenoid may be adapted to rotate a cam associated with the blades 1760. By adjusting the blade 1760, the revolutions per minute of the turbine 400*b* may be changed, thereby activating or deactivating a centrifugal clutch, such as the centrifugal clutch 502 discussed above in reference to FIGS. 4, 5, 11*a*, and 11*b*.

Figure 18A:
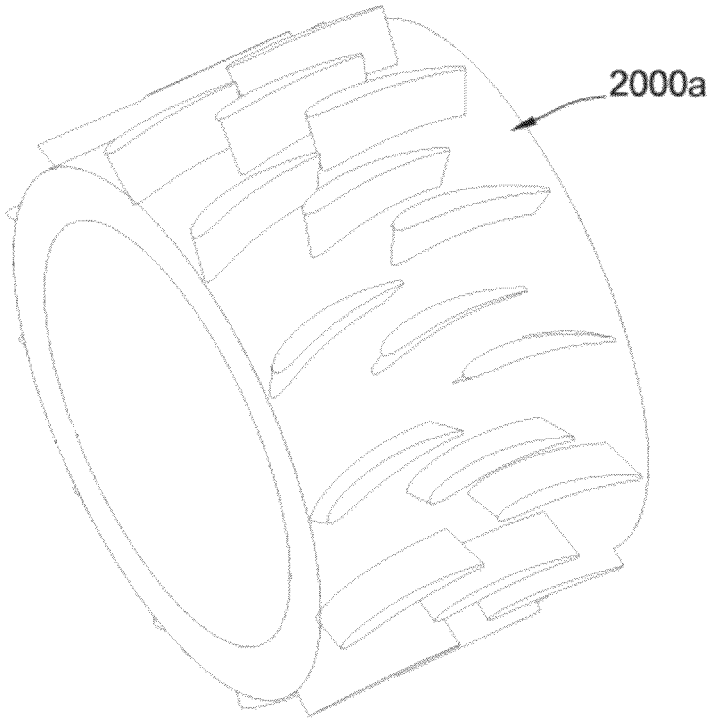
FIG. 18*a* is a perspective diagram of an embodiment of a plurality of blades of a turbine.
Figure 18B:
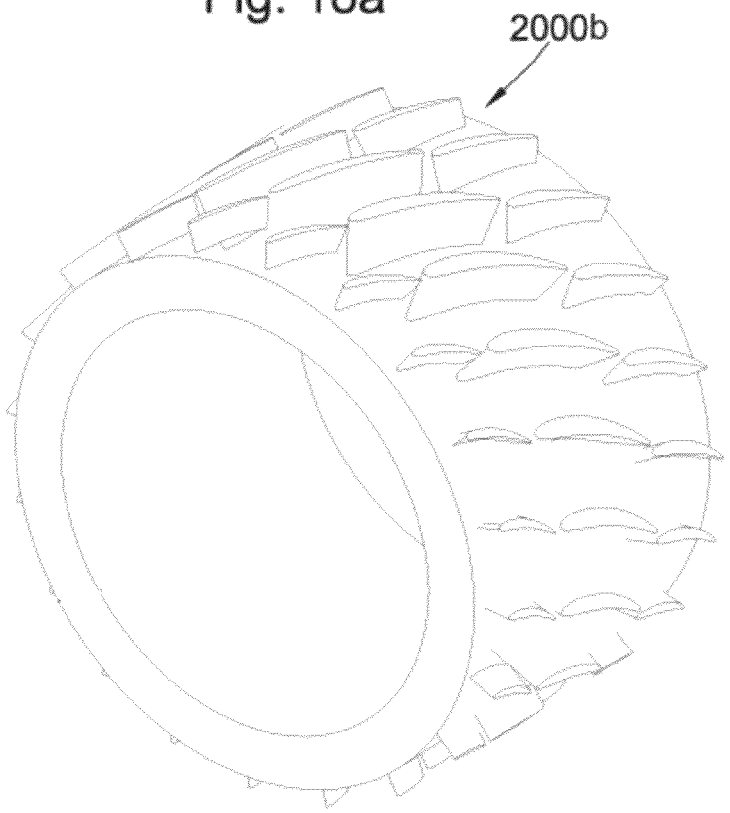
FIG. 18*b* is a perspective diagram of another embodiment of a plurality of blades of a turbine.

FIGS. 18*a* and 18*b* disclose an embodiment of a plurality of blades 2004*a* (FIG. 18*a*), 2004*b* (FIG. 18*b*) of a turbine. The turbine blades 2004*a* and 2004*b* may be configured to produce higher torque at a lower RPM.

Whereas the present invention has been described in particular relation to the drawings attached hereto, it should be understood that other and further modifications apart from those shown or suggested herein, may be made within the scope and spirit of the present invention.

What is claimed is:

1. A downhole drill string component, comprising:

a first end and a second end for attachment to an adjacent drill string component;

a bore in said drill string component for receiving drilling mud;

a turbine disposed within said bore configured to be rotated by drilling mud passing through said bore;

a centrifugal clutch that includes a gripper attached to a spring, said centrifugal clutch being connected to said turbine and operable by the rate of rotation of said turbine between an engaged position and a disengaged position;

a linear actuator coupled to said centrifugal clutch when said centrifugal clutch is in said engaged position and decoupled from said centrifugal clutch when said clutch is in said disengaged position, said linear actuator including:

a collar with a structure extending from said collar;

a cam housing with a guide slot formed in the cam housing, said structure of said collar interacting with said guide slot to rotate a cam; and, a driving gear;

a planetary gear system mechanically connected to said driving gear;

a screw connected to said planetary gear system and configured for connection to another component in the drill string, said screw being rotatably operable by said linear actuator when said centrifugal clutch is in said engaged position.

2. A downhole drill string component, comprising:

a first end and a second end for attachment to an adjacent drill string component;

a bore in said drill string component for receiving drilling mud;

a turbine disposed within said bore configured to be rotated by drilling mud passing through said bore;

a clutch connected to said turbine and operable by the rate of rotation of said turbine between an engaged position and a disengaged position;

a linear actuator coupled to said clutch when said clutch is in said engaged position and decoupled from said clutch when said clutch is in said disengaged position, said linear actuator including:

a collar with a structure extending from said collar;

a cam housing with a guide slot formed in the cam housing, said structure of said collar interacting with said guide slot to rotate a cam;

a mount configured to be engaged by said clutch, said mount including a pivot bracket having a plurality of weights attached to a distal end of said pivot bracket and a proximal end of said pivot bracket in contact with said collar; and, a driving gear;

a planetary gear system mechanically connected to said driving gear;

a screw connected to said planetary gear system and configured for connection to another component in the drill string, said screw being rotatably operable by said linear actuator when said clutch is in said engaged position.

3. The downhole drill string component of claim 2, wherein said bore has an inner surface, and wherein said linear actuator includes a sleeve with a surface in substantial contact with said inner surface of said bore.

4. The downhole drill string component of claim 3, wherein said sleeve includes at least one port movable to align and not align with a channel formed within a wall of the bore.

5. The downhole drill string component of claim 2, wherein said linear actuator includes a switch plate coupled to said driving gear, said switch plate configured to move when said cam rotates and thereby causing said driving gear to selectively engage the planetary gear system.

6. The downhole drill string component of claim 2, wherein said component further includes a reamer blade and wherein said linear actuator is connected to said reamer blade and operable to move said blade between a first position and a second position.

7. The downhole drill string component of claim 2, wherein said linear actuator controls forward and backward axial movement said screw.

8. A method of operating a component in a drill string positioned in a well-bore, said method comprising:

positioning a component in a drill string, said component having:

a first end and a second end for attachment to an adjacent drill string component;

a bore in said drill string component for receiving drilling mud;

a turbine disposed within said bore configured to be rotated by said flow of drilling mud passing through said bore;

a centrifugal clutch that includes a gripper attached to a spring, said centrifugal clutch being connected to said turbine and operable by the rate of rotation of said turbine between an engaged position and a disengaged position;

a linear actuator coupled to said centrifugal clutch when said centrifugal clutch is in said engaged position and decoupled from said centrifugal clutch when said centrifugal clutch is in said disengaged position, said linear actuator including:

a collar with a structure extending from said collar;

a cam housing with a guide slot formed in the cam housing, said structure of said collar interacting with said guide slot to rotate a cam; and, a driving gear;

a planetary gear system mechanically connected to said driving gear;

a screw connected to said planetary gear system and configured for connection to another component in said drill string, said screw being rotatably operable by said linear actuator when said clutch is in said engaged position;

positioning said drill string in said well-bore;

supplying drilling mud at a flow rate to said bore of said component;

varying said flow rate of said drilling mud between a first rate to cause said turbine to operate at a rate to cause said centrifugal clutch to move toward said engaged position to cause said planetary gear and said linear actuator to operate and a second rate in which said turbine is operating at a rate to cause said centrifugal clutch to disengage and in turn cause said planetary gear system and said linear actuator to not operate.

9. The downhole drill string component of claim 2, wherein said plurality of weights are configured to move radially away from a central axis of said drill string component and said proximal end of said pivot bracket pushes on said collar when said clutch engages said mount.

* * * * *